US009446498B1

(12) United States Patent
So et al.

(10) Patent No.: US 9,446,498 B1
(45) Date of Patent: Sep. 20, 2016

(54) CHEMICAL MECHANICAL POLISHING PAD WITH WINDOW

(71) Applicant: Rohm and Haas Electronic Materials CMP Holdings, Inc., Newark, DE (US)

(72) Inventors: Joseph So, Wilmington, DE (US); Bainian Qian, Newark, DE (US); Janet Tesfai, Philadelphia, PA (US)

(73) Assignee: Rohm and Hass Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 14/657,123

(22) Filed: Mar. 13, 2015

(51) Int. Cl.

| | |
|---|---|
| ***C23F 1/00*** | (2006.01) |
| ***B24B 37/20*** | (2012.01) |
| ***B24B 37/013*** | (2012.01) |
| ***B24B 49/12*** | (2006.01) |
| ***B24B 37/005*** | (2012.01) |

(52) U.S. Cl.
CPC ..... *B24B 37/205* (2013.01); *B24B 37/005* (2013.01); *B24B 37/013* (2013.01); *B24B 49/12* (2013.01)

(58) Field of Classification Search
CPC . B24B 37/013; B24B 37/205; B24B 37/016; B24B 37/22; B24B 37/26; B24B 37/24; H01L 21/30625
USPC ..... 451/41, 56, 59, 527; 156/345.13, 156/345.15, 345.16; 438/691, 692, 693
See application file for complete search history.

(56) References Cited

U.S. PATENT DOCUMENTS

| | | | | |
|---|---|---|---|---|
| 6,832,949 | B2 | 12/2004 | Konno et al. | |
| 7,520,797 | B2 * | 4/2009 | Bottema | B24B 37/013 156/87 |
| 8,182,312 | B2 * | 5/2012 | Truer | B24B 37/013 451/56 |
| 8,393,933 | B2 | 3/2013 | Qian et al. | |
| 2007/0042675 | A1 | 2/2007 | Benvegnu et al. | |
| 2009/0042480 | A1 * | 2/2009 | Shiro | B24B 37/205 451/6 |
| 2010/0330870 | A1 * | 12/2010 | Chen | A63H 3/40 446/343 |

* cited by examiner

*Primary Examiner* — Lan Vinh
(74) *Attorney, Agent, or Firm* — Thomas S. Deibert

(57) ABSTRACT

A chemical mechanical polishing pad is provided having a polishing layer; an endpoint detection window; subpad; and, a stack adhesive; wherein the subpad includes plurality of apertures in optical communication with the endpoint detection window; and, wherein the polishing surface of the polishing layer is adapted for polishing of a substrate.

7 Claims, 15 Drawing Sheets

CHEMICAL MECHANICAL POLISHING PAD WITH WINDOW

The present invention relates to chemical mechanical polishing pads with windows. More particularly, the present invention relates to a chemical mechanical polishing pad comprising a polishing layer; an endpoint detection window; subpad; and, a stack adhesive; wherein the subpad includes plurality of apertures in optical communication with the endpoint detection window; and, wherein the polishing surface of the polishing layer is adapted for polishing of a substrate.

The production of semiconductors typically involves several chemical mechanical polishing processes. In each CMP process, a polishing pad, optionally, in combination with a polishing solution, such as an abrasive-containing polishing slurry or an abrasive-free reactive liquid, removes material from a substrate in a manner that planarizes or maintains flatness for receipt of a subsequent layer. The stacking of these layers combines in a manner that forms an integrated circuit.

An important step in polishing processes used in wafer manufacture is a determination of an end-point to the polishing. Accordingly, a variety of planarization end-point detection methods have been developed, for example, methods involving optical in-situ measurements of the wafer surface. The optical technique involves providing the polishing pad with a window that is transparent to select wavelengths of light. A light beam is directed through the window onto the surface of a wafer being processed, where it is reflected back through the window onto a detector. Based on the return signal, properties of the wafer surface can be measured to facilitate a determination of when the polishing step is complete.

Chemical mechanical polishing pads having windows are disclosed by, for example, Roberts, in U.S. Pat. No. 5,605,760.

Conventional chemical mechanical polishing pad configurations having windows; however, are prone to increased polishing defects attributed to the window bulge issues. In some polishing pad configurations with windows, the window bulges outward and upward from the polishing platen. Such outward and upward window bulging is believed to result in increased polishing defects due to mechanical interaction between the bulging window and the substrate.

Conventional chemical mechanical polishing pad configurations having windows are also prone to uneven wear of the window during polishing of the substrate and conditioning of the polishing surface of the polishing pad. That is, with extended polishing and conditioning the windows of conventional chemical mechanical polishing pads tend to exhibit higher wear at the edges relative to the window center. As a result, over time the thickness of the window measured perpendicular to the polishing side varies across the window profile. The increasing variation in the window thickness leads to errors in polish endpoint determination. To avoid such endpoint determination errors, polishing pads are prematurely changed out and discarded (i.e., while the polishing layer still has remaining useful surface for polishing).

Accordingly, there is a continuing need for chemical mechanical polishing pad designs that alleviate the window bulge and uneven window wear problems associated with conventional chemical mechanical polishing pads having windows.

The present invention provides a chemical mechanical polishing pad, comprising: a polishing layer having a central axis, an outer perimeter, a polishing surface, a base surface and a polishing layer thickness, $T_P$, perpendicular to a plane of the polishing surface measured from the polishing surface to the base surface; an endpoint detection window having a polishing side, a platen side and a window thickness, $T_W$, perpendicular to the polishing side measured from the polishing side to the platen side; a subpad having a top surface, a bottom surface, a plurality of apertures, an outer edge and a subpad thickness, $T_S$, perpendicular to the top surface measured from the top surface to the bottom surface; and, a stack adhesive; wherein the endpoint detection window is incorporated into the chemical mechanical polishing pad, wherein the polishing side is disposed toward the polishing surface of the polishing layer; wherein the stack adhesive is interposed between the base surface of the polishing layer and the top surface of the subpad; wherein the plurality of apertures is in optical communication with the endpoint detection window; and, wherein the polishing surface of the polishing layer is adapted for polishing of a substrate.

The present invention provides a chemical mechanical polishing pad, comprising: a polishing layer having a central axis, an outer perimeter, a polishing surface, a base surface and a polishing layer thickness, $T_P$, perpendicular to a plane of the polishing surface measured from the polishing surface to the base surface; an endpoint detection window having a polishing side, a platen side and a window thickness, $T_W$, perpendicular to the polishing side measured from the polishing side to the platen side; a subpad having a top surface, a bottom surface, a plurality of apertures, an outer edge and a subpad thickness, $T_S$, perpendicular to the top surface measured from the top surface to the bottom surface; and, a stack adhesive; wherein the endpoint detection window is incorporated into the chemical mechanical polishing pad, wherein the polishing side is disposed toward the polishing surface of the polishing layer; wherein the stack adhesive is interposed between the base surface of the polishing layer and the top surface of the subpad; wherein the plurality of apertures is in optical communication with the endpoint detection window; wherein the subpad further comprises a plurality of cross members; wherein the plurality of apertures are separated by the plurality of cross members; and, wherein the plurality of apertures comprises at least three apertures; wherein the plurality of apertures consists of three adjacent apertures; wherein the three adjacent apertures consist of an inner aperture, a center aperture and an outer aperture; wherein the inner aperture has an inner aperture cross sectional area, $A_i$, parallel to the plane of the polishing surface; wherein the center aperture has a center aperture cross sectional area, $A_c$, parallel to the plane of the polishing surface; wherein the outer aperture has an outer aperture cross sectional area, $A_o$, parallel to the plane of the polishing surface; wherein the plurality of cross members consists of an inner member and an outer member; wherein the inner member separates the inner aperture from the center aperture; wherein the outer member separates the center aperture from the outer aperture; wherein the inner aperture cross sectional area, $A_i$, is substantially constant across the subpad thickness, $T_s$; wherein the center aperture cross sectional area, $A_c$, is substantially constant across the subpad thickness, $T_s$; wherein the outer aperture cross sectional area, $A_o$, is substantially constant across the subpad thickness, $T_s$; wherein the outer aperture has an outer aperture average cross sectional area, $A_{o\text{-}avg}$, parallel to the plane of the polishing surface across the subpad thickness, $T_s$; wherein the inner aperture has an inner aperture average cross sectional area, $A_{i\text{-}avg}$, parallel to the plane of the polishing surface across the subpad thickness, $T_s$; wherein the center aperture has an center aperture average cross sectional area, $A_{c\text{-}avg}$, parallel to the plane of the polishing surface across the subpad thickness, $T_s$; wherein $0.75*A_{o\text{-}avg} \leq A_{i\text{-}avg} \leq 1.25*A_{o\text{-}avg}$; wherein $0.5*(A_{i\text{-}avg}+A_{o\text{-}avg}) \leq A_c \leq 1.25*(A_{i\text{-}avg}+A_{o\text{-}avg})$; wherein the endpoint detection window has a window cross sectional area, $W_a$, parallel to the plane of the polishing surface; wherein the window cross sectional area, $W_a$, is substantially constant across the window thickness, $T_W$; wherein the endpoint detection window has a window length, $W_L$, parallel to the plane of the polishing surface measured along a window long dimension, $LD_W$, of the endpoint detection window; wherein the endpoint detection window has a window width, $W_W$, parallel to the plane of the polishing surface measured along a window short dimension, $SD_W$, of the endpoint detection window; wherein the window long dimension, $LD_W$, is perpendicular to the window short dimension, $SD_W$; wherein the polishing layer has a polishing layer radial line, $PL_R$, on the plane of the polishing surface that intersects the central axis and extends through the outer perimeter of the polishing layer; wherein the endpoint detection window is incorporated into the chemical mechanical polishing pad such that the window long dimension, $LD_W$, projects a window long dimension projection, $pLD_W$, on the plane of the polishing surface; wherein the window long dimension projection, $pLD_W$, substantially coincides with the polishing layer radial line, $PL_R$; wherein the plurality of apertures have an aperture length, $A_L$, parallel to the plane of the polishing surface measured along an aperture long dimension, $LD_A$, of the plurality of apertures; wherein the plurality of apertures have an aperture width, $A_W$, parallel to the plane of the polishing surface measured along an aperture short dimension, $SD_A$, of the plurality of apertures; wherein the aperture long dimension, $LD_A$, is perpendicular to the aperture short dimension, $SD_A$; wherein the plurality of apertures is integrated into the subpad such that the aperture long dimension, $LD_A$, projects an aperture long dimension projection, $pLD_A$, on the plane of the polishing surface; wherein the aperture long dimension projection, $pLD_A$, substantially coincides with the window long dimension projection, $pLD_W$; wherein the inner member has an inner member width, $W_{IM}$, parallel to the plane of the polishing surface measured along the aperture long dimension, $LD_A$, of the plurality of apertures; wherein the outer member has an outer member width, $W_{OM}$, parallel to the plane of the polishing surface measured along the aperture long dimension, $LD_A$, of the plurality of apertures; wherein the inner aperture has an inner aperture dimension, $D_i$, parallel to the plane of the polishing surface measured along the aperture long dimension, $LD_A$, of the plurality of apertures; wherein the outer aperture has an outer aperture dimension, $D_o$, parallel to the plane of the polishing surface measured along the aperture long dimension, $LD_A$, of the plurality of apertures; wherein the aperture length, $A_L$, of the plurality of apertures is essentially constant across the subpad thickness, $T_S$, and across the aperture width, $A_W$, of the plurality of apertures; wherein the plurality of apertures has an average aperture length, $A_{L\text{-}avg}$, across the subpad thickness, $T_S$, and across the aperture width, $A_W$, of the plurality of apertures; wherein the aperture width, $A_W$, of the plurality of apertures is essentially constant across the subpad thickness, $T_S$, and across the aperture length, $A_L$, of the plurality of apertures; wherein the plurality of apertures has an average aperture width, $A_{W\text{-}avg}$, for the plurality of apertures across the subpad thickness, $T_S$, and across the aperture length, $A_L$, of the plurality of apertures; wherein $A_{L\text{-}avg} \leq W_{L\text{-}avg}$, wherein $A_{W\text{-}avg} \leq W_{W\text{-}avg}$; and, wherein the polishing surface of the polishing layer is adapted for polishing of a substrate.

The present invention provides a method of polishing, comprising: providing a chemical mechanical polishing apparatus having a table, a light source and a photosensor; providing a substrate; providing a chemical mechanical polishing pad according to the present invention; installing onto the table the chemical mechanical polishing pad with the polishing surface disposed away from the table; optionally, providing a polishing medium at an interface between the polishing surface and the substrate; creating dynamic contact between the polishing surface and the substrate, wherein at least some material is removed from the substrate; and, determining a polishing endpoint by transmitting light from the light source through the endpoint detection window and analyzing the light reflected off the substrate, back through the endpoint detection window and incident upon the photosensor.

DETAILED DESCRIPTION

Figure 1:
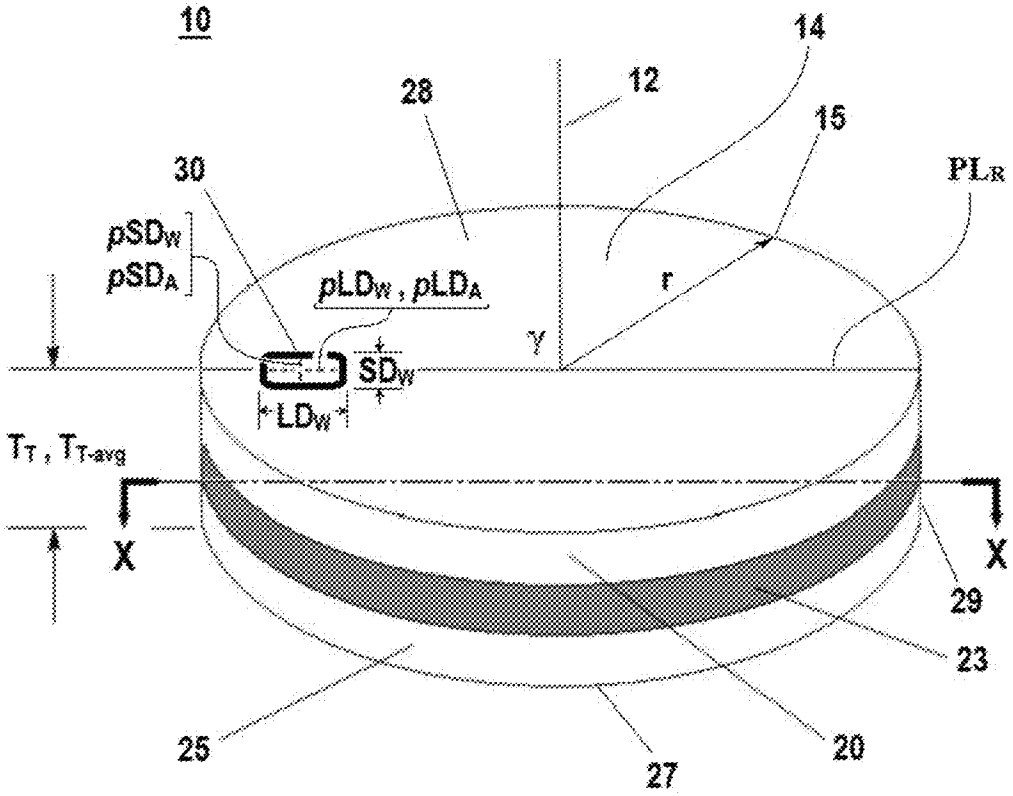
FIG. 1 is a depiction of a top perspective view of a chemical mechanical polishing pad of the present invention.
Figure 2:
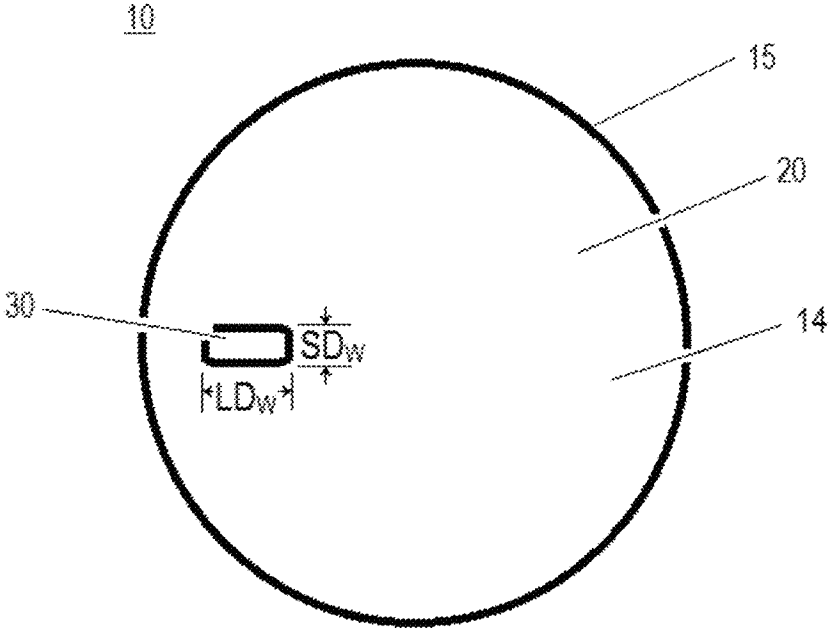
FIG. 2 is a top plan view of a chemical mechanical polishing pad of the present invention.

Applicant has surprisingly found that windows in chemical mechanical polishing pads configured according to the present invention are both resistant to window bulging and to uneven window wear, helping to minimize polishing defects attributable to window bulging and to maximize polishing pad life by reducing uneven window wear and the associated premature polishing pad retirement.

The term "total thickness, $T_T$" as used herein and in the appended claims in reference to a chemical mechanical polishing pad (10) having a polishing layer (20) with a polishing surface (14) means the thickness of the chemical mechanical polishing pad measured in a direction normal to the polishing surface (14) from the polishing surface (14) to the bottom surface (27) of the subpad (25). (See FIGS. 1 and 6-10).

The term "average total thickness, $T_{T\text{-}avg}$" as used herein and in the appended claims in reference to a chemical mechanical polishing pad (10) having a polishing layer (20) with a polishing surface (14) means the average of the total thickness, $T_T$, of the chemical mechanical polishing pad measured in a direction normal to the plane (28) the polishing surface (14) from the polishing surface (14) to the bottom surface (27) of the subpad (25). (See FIGS. 1 and 6-10).

The term "window thickness, $T_W$" as used herein and in the appended claims in reference to an endpoint detection window (30) having a polishing side (31) means the thickness of the endpoint detection window measured in a direction normal to the polishing side (31) from the polishing side (31) to the platen side (32) of the endpoint detection window (30). (See FIGS. 6-10).

The term "average window thickness, $T_{W\text{-}avg}$" as used herein and in the appended claims in reference to an endpoint detection window (30) having a polishing side (31) means the average of the window thickness, $T_W$, measured in a direction normal to the polishing side (31) from the polishing side (31) to the platen side (32) of the endpoint detection window (30). (See FIGS. 6-10).

The term "polishing layer thickness, $T_P$" as used herein and in the appended claims in reference to a polishing layer (20) having a polishing surface (14) means the thickness of the polishing layer measured in a direction normal to the polishing surface (14) from the polishing surface (14) to the base surface (17) of the polishing layer (20). (See FIGS. 6-10).

The term "average polishing layer thickness, $T_{P\text{-}avg}$" as used herein and in the appended claims in reference to a polishing layer (20) having a polishing surface (14) means the average of the polishing layer thickness, $T_P$, measured in a direction normal to the polishing surface (14) from the polishing surface (14) to the base surface (17) of the polishing layer (20). (See FIGS. 6-10).

The term "subpad thickness, $T_S$" as used herein and in the appended claims in reference to a subpad (25) having a top surface (26) means the thickness of the subpad measured in a direction normal to the top surface (26) from the top surface (26) to the bottom surface (27) of the subpad (25). (See FIGS. 6-10).

The term "average subpad thickness, $T_{S\text{-}avg}$" as used herein and in the appended claims in reference to a subpad (25) having a top surface (26) means the average of the subpad thickness, $T_S$, measured in a direction normal to the top surface (26) from the top surface (26) to the bottom surface (27) of the subpad (25). (See FIGS. 6-10).

The term "aperture cross sectional area" as used herein and in the appended claims in reference to a given aperture (e.g., an inner aperture cross sectional area, $A_i$; a center aperture cross sectional area, $A_c$; an outer aperture cross sectional area, $A_o$) means a geometric cross sectional area of the aperture in a plane parallel to the plane of the polishing surface (28). (See FIG. 5).

The term "average cross sectional area" as used herein and in the appended claims in reference to a given aperture (e.g., an inner aperture average cross sectional area, $A_{i\text{-}avg}$; a center aperture average cross sectional area, $A_{c\text{-}avg}$; an outer aperture average cross sectional area, $A_{o\text{-}avg}$) means the average geometric cross sectional area of the aperture in a plane parallel to the plane (28) of the polishing layer (20) across the subpad thickness, $T_S$. (See FIG. 5).

Figure 3:
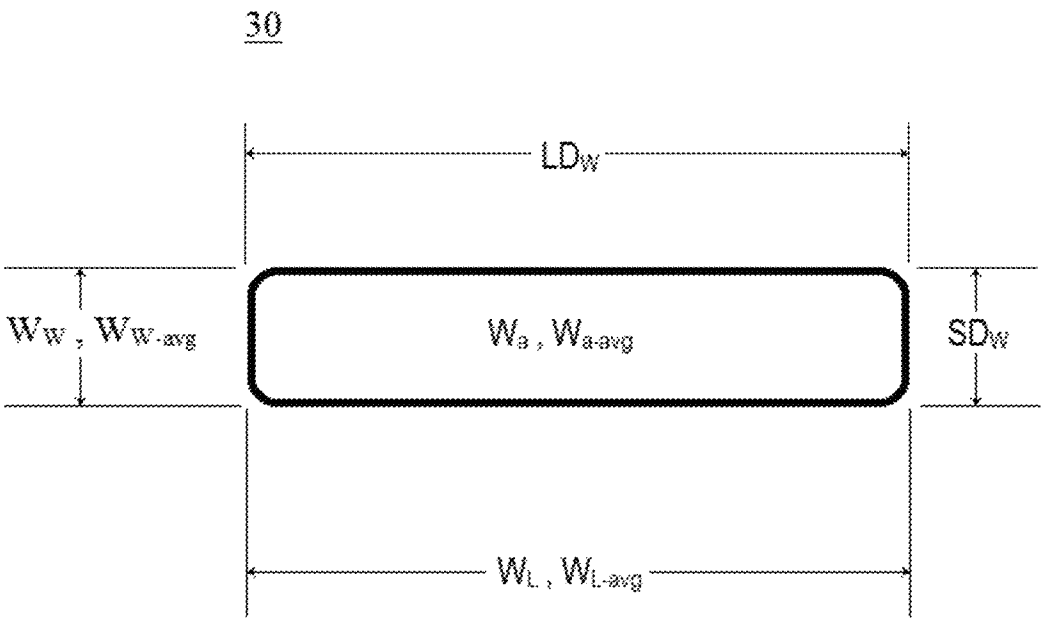
FIG. 3 is a top plan view of the endpoint detection window of FIG. 2.
Figure 4:
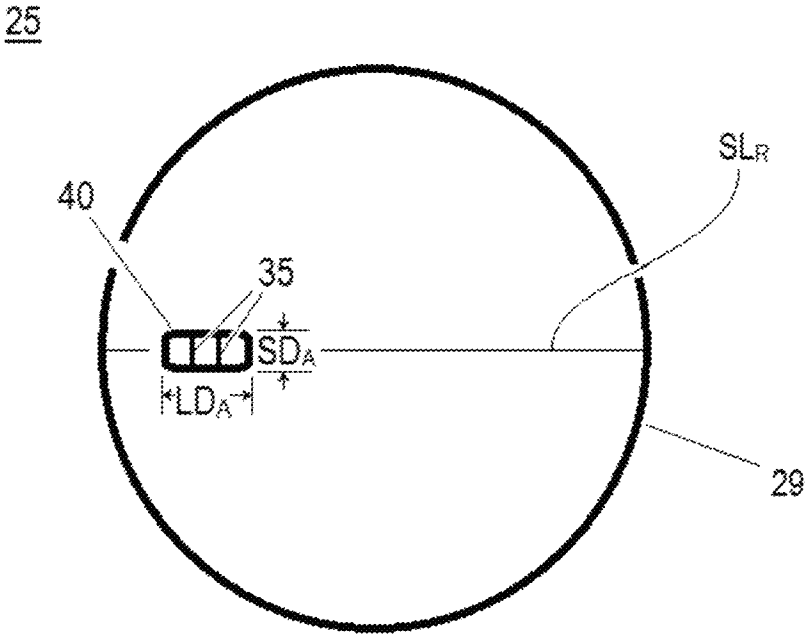
FIG. 4 is a cross sectional, cut away top plan view of a chemical mechanical polishing pad of the present invention taken along line X-X in FIG. 1.

The term "substantially constant" as used herein and in the appended claims in reference to a given cross sectional area (e.g., an inner aperture cross sectional area, $A_i$; a center aperture cross section area, $A_c$; an outer aperture cross sectional area, $A_o$; an endpoint detection window cross sectional area, $W_a$) means that the cross sectional area varies by less than 10% across the relevant thickness (e.g., the smallest cross sectional area for a given aperture parallel to the plane of the polishing surface is ≥0.90*the largest cross sectional area for that aperture parallel to the plane of the polishing surface across the subpad thickness, $T_S$; the smallest cross sectional area of the endpoint detection window parallel to the plane of the polishing surface is ≥0.90*the largest cross sectional area of the endpoint detection window parallel to the plane of the polishing surface across the window thickness, $T_W$). (See FIGS. 3 and 5).

The term "essentially constant" as used herein and in the appended claims in reference to a given dimension (e.g., an aperture width, $A_W$; an aperture length, $A_L$; a window length, $W_L$; window width, $W_W$; an inner aperture dimension, $D_i$; an outer aperture dimension, $D_o$; an inner member width, $W_{IM}$; an outer member width, $W_{OM}$) means that the dimension varies by less than 10% for the relevant feature across the relevant thickness (e.g., the smallest window length is ≥0.90*the largest window length of the endpoint detection window across the window thickness, $T_W$, and across the window width, $W_W$; the smallest inner member width is ≥0.90*the largest inner member width across the subpad thickness, $T_S$, and across the aperture width, $A_W$, of the plurality of apertures). (See FIGS. 1-10).

The term "substantially coincides with" as used herein and in the appended claims in reference to a projection on the plane (28) of the polishing surface (14) (e.g., a window long dimension projection, $pLD_W$; an aperture long dimension projection, $pLD_A$) and a polishing layer radial line, $PL_R$, on the plane (28) means that the projection (e.g., $pLD_W$, $pLD_A$) intersects the polishing layer radial line, $PL_R$, at an angle of 0 to 10°. (See FIG. 1).

The term "substantially circular cross section" as used herein and in the appended claims in reference to a chemical mechanical polishing pad (10) means that the longest radius, r, of the cross section from the central axis (12) to the outer perimeter (15) of the polishing surface (14) of the polishing layer (20) is ≤20% longer than the shortest radius, r, of the cross section from the central axis (12) to the outer perimeter (15) of the polishing surface (14). (See FIG. 1).

The term "polishing medium" as used herein and in the appended claims encompasses particle containing polishing solutions and nonparticle containing polishing solutions, such as abrasive free and reactive liquid polishing solutions.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines (including diamines and polyamines) or a combination of water and amines (including diamines and polyamines).

Figure 11:
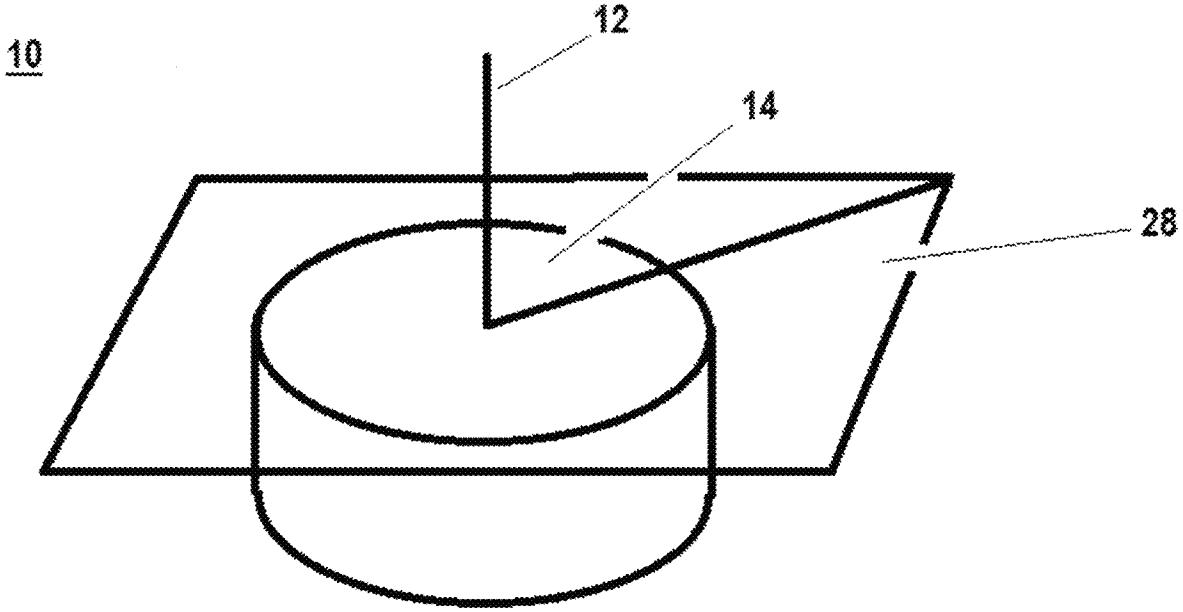
FIG. 11 is a depiction of a top perspective view of a chemical mechanical polishing pad of the present invention.

The chemical mechanical polishing pad (10) of the present invention is preferably adapted for rotation about a central axis (12). Preferably, the chemical mechanical polishing pad (10) is adapted for rotation in a plane (28) of the polishing surface (14) that is at an angle, γ, of 85 to 95° (more preferably, of 88 to 92°; most preferably, of 90°) to the central axis (12). (See FIGS. 1 and 11).

Preferably, the chemical mechanical polishing pad (10) of the present invention is designed to facilitate the polishing of a substrate selected from at least one of a magnetic substrate, an optical substrate and a semiconductor substrate. More preferably, the chemical mechanical polishing pad (10) of the present invention is designed to facilitate the polishing of a semiconductor substrate.

The chemical mechanical polishing pad (10) of the present invention, comprises: a polishing layer (20) having a central axis (12), an outer perimeter (15), a polishing surface (14), a base surface (17) and a polishing layer thickness, $T_P$, perpendicular to a plane (28) of the polishing surface (14) measured from the polishing surface (14) to the base surface (17); an endpoint detection window (30) having a polishing side (31), a platen side (32) and a window thickness, $T_W$, perpendicular to the polishing side (31) measured from the polishing side (31) to the platen side (32); a subpad (25) having a top surface (26), a bottom surface (27), a plurality of apertures (40), an outer edge (29) and a subpad thickness, $T_S$, perpendicular to the top surface (26) measured from the top surface (26) to the bottom surface (27); and, a stack adhesive (23); wherein the endpoint detection window (30) is incorporated into the chemical mechanical polishing pad (10), wherein the polishing side (31) is disposed toward the polishing surface (14) of the polishing layer (20); wherein the stack adhesive (23) is interposed between the base surface (17) of the polishing layer (20) and the top surface (26) of the subpad (25); wherein the plurality of apertures (40) is in optical communication with the endpoint detection window (30); and, wherein the polishing surface (14) of the polishing layer (20) is adapted for polishing of a substrate. (See FIGS. 1-11).

Preferably, in the chemical mechanical polishing pad (10) of the present invention, the polishing layer (20) is a polymeric material comprising a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, poly (urethanes), polyether sulfones, polyamides, polyether imides, polyketones, epoxies, silicones, EPDM, and combinations thereof. More preferably, the polishing layer comprises a poly(urethane). Most preferably, the polishing layer comprises a polyurethane. Preferably, the polishing layer (20) further comprises a plurality of microelements. Preferably, the plurality of microelements are uniformly dispersed throughout the polishing layer (20). Preferably, the plurality of microelements is selected from entrapped gas bubbles, hollow core polymeric materials, liquid filled hollow core polymeric materials, water soluble materials, an insoluble phase material (e.g., mineral oil) and a combination thereof. More preferably, the plurality of microelements is selected from entrapped gas bubbles and hollow core polymeric materials uniformly distributed throughout the polishing layer (20). Preferably, the plurality of microelements has a weight average diameter of less than 150 μm (more preferably of less than 50 μm; most preferably of 10 to 50 μm). Preferably, the plurality of microelements comprise polymeric microballoons with shell walls of either polyacrylonitrile or a polyacrylonitrile copolymer (e.g., Expancel® from Akzo Nobel). Preferably, the plurality of microelements are incorporated into the polishing layer (20) at 0 to 35 vol % porosity (more preferably 10 to 25 vol % porosity). One of ordinary skill in the art will understand to select a polishing layer (20) having a polishing layer thickness, $T_P$, suitable for use in a chemical mechanical polishing pad (10) for a given polishing operation. Preferably, the polishing layer (20) exhibits an average polishing layer thickness, $T_{P\text{-}avg}$, perpendicular to a plane (28) of the polishing surface (14). More preferably, the average polishing layer thickness, $T_{P\text{-}avg}$, is 20 to 150 mils (more preferably 30 to 130 mils; most preferably 70 to 90 mils). (See FIGS. 6-10).

Preferably, in the chemical mechanical polishing pad (10) of the present invention, the polishing layer (20) has a polishing surface (14), wherein the polishing surface (14) has at least one of a macrotexture and a microtexture to facilitate polishing of a substrate. Preferably, the polishing surface (14) has a macrotexture, wherein the macrotexture is designed to do at least one of (i) alleviate at least one of hydroplaning; (ii) influence polishing medium flow; (iii) modify the stiffness of the polishing layer; (iv) reduce edge effects; and, (v) facilitate the transfer of polishing debris away from the area between the polishing surface and the substrate.

Preferably, in the chemical mechanical polishing pad (10) of the present invention, the polishing layer (20) has a polishing surface (14), wherein the polishing surface (14) has a macrotexture selected from at least one of perforations and grooves. Preferably, the perforations extend from the polishing surface (14) part way or all of the way through the polishing layer thickness, $T_P$, of the polishing layer (20). Preferably, the polishing surface (14) has grooves arranged on the polishing surface (14) such that upon rotation of the chemical mechanical polishing pad (10) during polishing, at least one groove sweeps over the substrate. Preferably, the grooves are selected from curved grooves, linear grooves and combinations thereof. The grooves exhibit a depth of ≥10 mils; preferably 10 to 150 mils. Preferably, the grooves form a groove pattern that comprises at least two grooves having a combination of a depth selected from ≥10 mils, ≥15 mils and 15 to 150 mils; a width selected from ≥10 mils and 10 to 100 mils; and a pitch selected from ≥30 mils, ≥50 mils, 50 to 200 mils, 70 to 200 mils, and 90 to 200 mils.

Preferably, in the chemical mechanical polishing pad (10) of the present invention, the endpoint detection window (30) is selected from the group consisting of an integral window and a plug in place window. More preferably, the endpoint detection window (30) is selected from the group consisting of (a) an integral window, wherein the integral window is incorporated in the polishing layer (20) (See FIGS. 6-7); (b) a plug in place window, wherein the plug in place window is incorporated into the chemical mechanical polishing pad on the subpad (25) (See FIG. 8); (c) a plug in place window, wherein the plug in place window is incorporated into the chemical mechanical polishing pad on the stack adhesive (23) (See FIGS. 9-10). Most preferably, the endpoint detection window (30) is an integral window, wherein the integral window is incorporated in the polishing layer (20) (See FIGS. 6-7). One of ordinary skill in the art will know how to select an appropriate material of construction for the endpoint detection window (30).

Preferably, in the chemical mechanical polishing pad (10) of the present invention, the endpoint detection window (30) has a window cross sectional area, $W_a$, parallel to the plane (28) of the polishing surface (14). Preferably, the window cross sectional area, $W_a$, is substantially constant across the window thickness, $T_W$. (See FIGS. 1-3).

Preferably, in the chemical mechanical polishing pad (10) of the present invention, the endpoint detection window (30) has a window length, $W_L$, measured along a window long dimension, $LD_W$, of the endpoint detection window (30) parallel to the plane (28) of the polishing surface (14); wherein the endpoint detection window (30) has a window width, $W_W$, measured along a window short dimension, $SD_W$, of the endpoint detection window (30) parallel to the plane (28) of the polishing surface (14); wherein the window long dimension, $LD_W$, is perpendicular to the window short dimension, $SD_W$; wherein the polishing layer (20) has a polishing layer radial line, $PL_R$, on the plane (28) of the polishing surface (14) that intersects the central axis (12) and extends through the outer perimeter (15) of the polishing layer (20); wherein the endpoint detection window (30) is incorporated into the polishing pad (10) such that the window long dimension, $LD_W$, projects a window long dimension projection, $pLD_W$, on a plane (28) of the polishing surface (14); wherein the window long dimension projection, $pLD_W$, substantially coincides with the polishing layer radial line, $PL_R$. (See FIG. 1). Preferably, the window length, $W_L$, is essentially constant across the window thickness, $T_W$. More preferably, the window length, $W_L$, is essentially constant across the window thickness, $T_W$, and across the window width, $W_W$. Preferably, the endpoint detection window (30) has an average window length, $W_{L\text{-}avg}$ across the window thickness, $T_W$, and across the window width, $W_W$; wherein the average window length, $W_{L\text{-}avg}$, is 35 to 75 mm (more preferably, 44 to 70 mm; still more preferably, 50 to 65 mm; most preferably, 55 to 60 mm). Preferably, the window width, $W_W$, is essentially constant across the window thickness, $T_W$. More preferably, the window width, $W_W$, is essentially constant across the window thickness, $T_W$, and across the window length, $W_L$. Preferably, the endpoint detection window (30) has an average window width, $W_{W\text{-}avg}$, across the window thickness, $T_W$, and across the window length, $W_L$; wherein the average window width, $W_{W\text{-}avg}$, is 6 to 40 mm (more preferably, 10 to 35 mm; still more preferably, 15 to 25 mm; most preferably, 19 to 21 mm). (See FIGS. 1-3).

Preferably, in the chemical mechanical polishing pad (10) of the present invention, the subpad (25) comprises a material selected from the group consisting of an open cell foam, a closed cell foam, a woven material, a nonwoven material (e.g., felted, spun bonded, and needle punched materials), and combinations thereof. One of ordinary skill in the art will know to select an appropriate material for use in the subpad (25).

Preferably, in the chemical mechanical polishing pad (10) of the present invention, the subpad (25) has a plurality of apertures (40), wherein the plurality of apertures (40) extend from the bottom surface (27) of the subpad (25) to the top surface (26) of the subpad (25). (See FIGS. 6-10).

Preferably, in the chemical mechanical polishing pad (10) of the present invention, the subpad (25) further comprises a plurality of cross members (35); wherein the plurality of apertures (40) are separated by the plurality of cross members (35); and, wherein the plurality of apertures (40) comprises at least three apertures. (See FIGS. 4-10).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the inner aperture (41) has an inner aperture cross sectional area, $A_i$, parallel to the plane (28) of the polishing surface (14); wherein the center aperture (45) has a center aperture cross sectional area, $A_c$, parallel to the plane (28) of the polishing surface (14); wherein the outer aperture (47) has an outer aperture cross sectional area, $A_o$, parallel to the plane (28) of the polishing surface (14); wherein the plurality of cross members (35) consists of an inner member (33) and an outer member (36); wherein the inner member (33) separates the inner aperture (42) from the center aperture (45); and, wherein the outer member (36) separates the center aperture (45) from the outer aperture (47). Preferably, the inner aperture cross sectional area, $A_i$, is substantially constant across the subpad thickness, $T_s$. Preferably, the center aperture cross sectional area, $A_c$, is substantially constant across the subpad thickness, $T_s$. Preferably, the outer aperture cross sectional area, $A_o$, is substantially constant across the subpad thickness, $T_s$. More preferably, the inner aperture cross sectional area, $A_i$, is substantially constant across the subpad thickness, $T_s$; the center aperture cross sectional area, $A_c$, is substantially constant across the subpad thickness, $T_s$; and, the outer aperture cross sectional area, $A_o$, is substantially constant across the subpad thickness, $T_s$. (See FIGS. 4-10).

Preferably, in the chemical mechanical polishing pad (10) of the present invention, the subpad (25) has a plurality of apertures (40), wherein the plurality of apertures (40) have an aperture length, $A_L$, measured along an aperture long dimension, $LD_A$, of the plurality of apertures (40) parallel to the plane (28) of the polishing surface (14); wherein the plurality of apertures (40) have an aperture width, $A_W$, parallel to the plane (28) of the polishing surface (14) measured along an aperture short dimension, $SD_A$, of the plurality of apertures (40); wherein the aperture long dimension, $LD_A$, is perpendicular to the aperture short dimension, $SD_A$; wherein the plurality of apertures (40) is integrated into the subpad (25) such that the aperture long dimension, $LD_A$, projects an aperture long dimension projection, $pLD_A$, on the plane (28) of the polishing surface (14); wherein the aperture long dimension projection, $pLD_A$, substantially coincides with the window long dimension projection, $pLD_W$. Preferably, the aperture length, $A_L$, of the plurality of apertures (40) is essentially constant across the subpad thickness, $T_S$. More preferably, the aperture length, $A_L$, of the plurality of apertures (40) is essentially constant across the subpad thickness, $T_S$, and across the aperture width, $A_W$, of the plurality of apertures (40). Preferably, the plurality of apertures (40) has an average aperture length, $A_{L\text{-}avg}$, across the subpad thickness, $T_S$, and across the aperture width, $A_W$, of the plurality of apertures (40); wherein the average aperture length, $A_{L\text{-}avg}$, is 28 to 69 mm (preferably, 37 to 64 mm; more preferably, 43 to 59 mm; most preferably, 48 to 54 mm). Preferably, the plurality of apertures (40) have an average aperture length, $A_{L\text{-}avg}$; wherein $A_{L\text{-}avg} \leq W_{L\text{-}avg}$ (preferably, $A_{L\text{-}avg} < W_{L\text{-}avg}$; more preferably, $0.75 * W_{L\text{-}avg} \leq A_{L\text{-}avg} \leq 0.95 * W_{L\text{-}avg}$; most preferably, $0.85 * W_{L\text{-}avg} \leq A_{L\text{-}avg} \leq 0.9 * W_{L\text{-}avg}$). Preferably, the aperture width, $A_W$, of the plurality of apertures (40) is essentially constant across the subpad thickness, $T_S$. More preferably, the aperture width, $A_W$, of the plurality of apertures (40) is essentially constant across the subpad thickness, $T_S$, and across the aperture length, $A_L$, of the plurality of apertures (40). Preferably, the plurality of apertures (40) has an average aperture width, $A_{W\text{-}avg}$, across the subpad thickness, $T_S$, and across the aperture length, $A_L$, of the plurality of apertures (40); wherein the average aperture width, $A_{W\text{-}avg}$, is 3 to 34 mm (preferably, 5 to 29 mm; more preferably, 7.5 to 20 mm; most preferably, 10 to 15 mm). Preferably, the plurality of apertures (40) have an average aperture width, $A_{W\text{-}avg}$; wherein $A_{W\text{-}avg} \leq W_{W\text{-}avg}$ (preferably, $A_{W\text{-}avg} < W_{W\text{-}avg}$; more preferably, $0.5 * W_{W\text{-}avg} \leq A_{W\text{-}avg} \leq 0.75 * W_{W\text{-}avg}$; most preferably, $0.6 * W_{W\text{-}avg} \leq A_{W\text{-}avg} \leq 0.7 * W_{W\text{-}avg}$). (See FIGS. 1-10).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the inner aperture (41) has an inner aperture average cross sectional area, $A_{i\text{-}avg}$, parallel to the plane (28) of the polishing surface (14) across the subpad thickness, $T_S$; wherein the center aperture (45) has a center aperture average cross sectional area, $A_{c\text{-}avg}$, parallel to the plane (28) of the polishing surface (14) across the subpad thickness, $T_S$; wherein the outer aperture (47) has an outer aperture average cross sectional area, $A_{o\text{-}avg}$, parallel to the plane (28) of the polishing surface (14) across the subpad thickness, $T_S$; and, wherein $$0.75*A_{o\text{-}avg} \leq A_{i\text{-}avg} \leq 1.25*A_{o\text{-}avg}$$

(preferably, wherein $0.9*A_{o\text{-}avg} \leq A_{i\text{-}avg} \leq 1.1*A_{o\text{-}avg}$; more preferably, wherein $0.95*A_{o\text{-}avg} \leq A_{i\text{-}avg} \leq 1.05*A_{o\text{-}avg}$; most preferably, wherein $A_{o\text{-}avg}=A_{i\text{-}avg}$). (See FIGS. 4-10).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the inner aperture (41) has an inner aperture average cross sectional area, $A_{i\text{-}avg}$, parallel to the plane (28) of the polishing surface (14) across the subpad thickness, $T_S$; wherein the center aperture (45) has a center aperture average cross sectional area, $A_{c\text{-}avg}$, parallel to the plane (28) of the polishing surface (14) across the subpad thickness, $T_S$; wherein the outer aperture (47) has an outer aperture average cross sectional area, $A_{o\text{-}avg}$, parallel to the plane (28) of the polishing surface (14) across the subpad thickness, $T_S$; and, wherein $$0.5*(A_{i\text{-}avg}+A_{o\text{-}avg}) \leq A_c \leq 1.25*(A_{i\text{-}avg}+A_{o\text{-}avg})$$

(preferably, wherein $0.75*(A_{i\text{-}avg}+A_{o\text{-}avg}) \leq A_{c\text{-}avg} \leq 1.1*(A_{i\text{-}avg}+A_{o\text{-}avg})$; more preferably, wherein $0.9*(A_{i\text{-}avg}+A_{o\text{-}avg}) \leq A_{c\text{-}avg} \leq 0.95*(A_{i\text{-}avg}+A_{o\text{-}avg})$). (See FIGS. 4-10).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the inner aperture (41) has an inner aperture average cross sectional area, $A_{i\text{-}avg}$, parallel to the plane (28) of the polishing surface (14) across the subpad thickness, $T_S$; wherein the center aperture (45) has a center aperture average cross sectional area, $A_{c\text{-}avg}$, parallel to the plane (28) of the polishing surface (14) across the subpad thickness, $T_S$; wherein the outer aperture (47) has an outer aperture average cross sectional area, $A_{o\text{-}avg}$, parallel to the plane (28) of the polishing surface (14) across the subpad thickness, $T_S$; wherein $$0.75*A_{o\text{-}avg} \leq A_{i\text{-}avg} \leq 1.25*A_{o\text{-}avg}$$

(preferably, wherein $0.9*A_{o\text{-}avg} \leq A_{i\text{-}avg} \leq 1.1*A_{o\text{-}avg}$; more preferably, wherein $0.95*A_{o\text{-}avg} \leq A_{i\text{-}avg} \leq 1.05*A_{o\text{-}avg}$; most preferably, wherein $A_{o\text{-}avg}=A_{i\text{-}avg}$); and, wherein $$0.5*(A_{i\text{-}avg}+A_{o\text{-}avg}) \leq A_c \leq 1.25*(A_{i\text{-}avg}+A_{o\text{-}avg})$$

(preferably, wherein $0.75*(A_{i\text{-}avg}+A_{o\text{-}avg}) \leq A_{c\text{-}avg} \leq 1.1*(A_{i\text{-}avg}+A_{o\text{-}avg})$; more preferably, wherein $0.9*(A_{i\text{-}avg}+A_{o\text{-}avg}) \leq A_{c\text{-}avg} \leq 0.95*(A_{i\text{-}avg}+A_{o\text{-}avg})$). (See FIGS. 4-10).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the inner aperture (42) has an inner aperture dimension, $D_i$, parallel to the plane (28) of the polishing surface (14) measured along the aperture long dimension, $LD_A$, of the plurality of apertures (40). Preferably, the inner aperture dimension, $D_i$, is essentially constant across the subpad thickness, $T_S$. More preferably, the inner aperture dimension, $D_i$, is essentially constant across the subpad thickness, $T_S$, and across the aperture width, $A_W$, of the plurality of apertures (40). Preferably, the inner aperture (42) has an average inner aperture dimension, $D_{i\text{-}avg}$, across the subpad thickness, $T_S$, and across the aperture width, $A_W$, of the plurality of apertures (40); wherein the average inner aperture dimension, $D_{i\text{-}avg}$, is 2 to 10 mm (preferably, 2.5 to 7.5 mm; more preferably, 3 to 5 mm; most preferably, 3.5 to 4 mm). (See FIGS. 1 and 4-5).

Preferably, in the chemical mechanical polishing pad (10) of the present invention, the subpad (25) has a plurality of apertures (40), wherein the plurality of apertures (40) consists of three adjacent apertures (41); wherein the three adjacent apertures (41) consist of an inner aperture (42), a center aperture (45) and an outer aperture (47); wherein the outer aperture (47) has an outer aperture dimension, $D_o$, parallel to the plane (28) of the polishing surface (14) measured along the aperture long dimension, $LD_A$, of the plurality of apertures (40). Preferably, the outer aperture dimension, $D_o$, is essentially constant across the subpad thickness, $T_S$. More preferably, the outer aperture dimension, $D_o$, is essentially constant across the subpad thickness, $T_S$, and across the aperture width, $A_W$, of the plurality of apertures (40). Preferably, the outer aperture (47) has an average outer aperture dimension, $D_{o\text{-}avg}$, across the subpad thickness, $T_S$, and across the aperture width, $A_W$, of the plurality of apertures (40); wherein the average outer aperture dimension, $D_{o\text{-}avg}$, is 2 to 10 mm (preferably, 2.5 to 7.5 mm; more preferably, 3 to 5 mm; most preferably, 3.5 to 4 mm). (See FIGS. 1 and 4-5).

Preferably, in the chemical mechanical polishing pad (10) of the present invention, the subpad (25) has a plurality of cross members (35); wherein the plurality of cross members (35) consists of an inner member (33) and an outer member (36); wherein the inner member (33) separates the inner aperture (42) from the center aperture (45); and, wherein the outer member (36) separates the center aperture (45) from the outer aperture (47). Preferably, the inner member (33) has an inner member width, $W_{IM}$, parallel to the plane (28) of the polishing surface (14) measured along the aperture long dimension, $LD_A$, of the plurality of apertures (40). Preferably, the inner member width, $W_{IM}$, is essentially constant across the subpad thickness, $T_S$. More preferably, the inner member width, $W_{IM}$, is essentially constant across the subpad thickness, $T_S$, and across the aperture width, $A_W$, of the plurality of apertures (40). Preferably, the inner member (33) has an average inner member width, $W_{IM\text{-}avg}$ across the subpad thickness, $T_S$, and across the aperture width, $A_W$, of the plurality of apertures (40); wherein the average inner member width, $W_{IM\text{-}avg}$, is 1 to 10 mm; preferably, 2 to 6 mm; more preferably 2.5 to 5 mm; most preferably, 3 to 4 mm. Preferably, the outer member (36) has an outer member width, $W_{OM}$, parallel to the plane (28) of the polishing surface (14) measured along the aperture long dimension, $LD_A$, of the plurality of apertures (40). Preferably, the outer member width, $W_{OM}$, is essentially constant across the subpad thickness, $T_S$. More preferably, the outer member width, $W_{OM}$, is essentially constant across the subpad thickness, $T_S$, and across the aperture width, $A_W$, of the plurality of apertures (40). Preferably, the outer member (36) has an average outer member width, $W_{OM\text{-}avg}$, across the subpad thickness, $T_S$, and across the aperture width, $A_W$, of the plurality of apertures (40); wherein the average outer member width, $W_{OM\text{-}avg}$, is 1 to 10 mm (preferably, 2 to 6 mm; more preferably 2.5 to 5 mm; most preferably, 3 to 4 mm).

Preferably, in the chemical mechanical polishing pad (10) of the present invention, the stack adhesive (23) interposed between the base surface (17) of the polishing layer (20) and the top surface (26) of the subpad (25) is an adhesive selected from the group consisting of pressure sensitive adhesives, reactive hot melt adhesives, contact adhesives and combinations thereof. More preferably, the stack adhesive (23) is selected from the group consisting of reactive hot melt adhesives and pressure sensitive adhesives. Most preferably, the stack adhesive (23) is a reactive hot melt adhesive. Preferably, the reactive hot melt adhesive is a cured reactive hot melt adhesive that has a melting temperature in its uncured state of 50 to 150° C. (preferably, of 115 to 135° C.) and has a pot life of ≤90 minutes after melting. Most preferably, the reactive hot melt adhesive is a polyurethane resin (e.g., Mor-Melt™ R5003 available from Rohm and Haas Company).

Preferably, the chemical mechanical polishing pad (10) of the present invention further comprises a pressure sensitive platen adhesive layer (70); wherein the pressure sensitive platen adhesive is disposed on the bottom surface (27) of the subpad (25). More preferably, the chemical mechanical polishing pad (10) of the present invention further comprises a pressure sensitive platen adhesive layer (70) and a release liner (75); wherein the pressure sensitive platen adhesive is disposed on the bottom surface (27) of the subpad (25); and, wherein the pressure sensitive platen adhesive layer (70) is interposed between the release liner (75) and the bottom surface (27) of the subpad (25). One of ordinary skill in the art will know to select an appropriate pressure sensitive adhesive material and release liner material for use in the chemical mechanical polishing pad (10) of the present invention.

Preferably, the method of polishing of the present invention, comprises: providing a chemical mechanical polishing apparatus having a table, a light source and a photosensor; providing a substrate; providing a chemical mechanical polishing pad of the present invention; installing onto the table the chemical mechanical polishing pad with the polishing surface disposed away from the table; optionally, providing a polishing medium at an interface between the polishing surface and the substrate; creating dynamic contact between the polishing surface and the substrate, wherein at least some material is removed from the substrate; and, determining a polishing endpoint by transmitting light from the light source through the endpoint detection window and analyzing the light reflected off the substrate, back through the endpoint detection window and incident upon the photosensor. Preferably, the substrate is selected from the group consisting of at least one of a magnetic substrate, an optical substrate and a semiconductor substrate. More preferably, the substrate is a semiconductor substrate.

Some embodiments of the present invention will now be described in detail in the following Examples.

Comparative Example C1 and Examples 1-5

Polishing Pads

Figure 5:
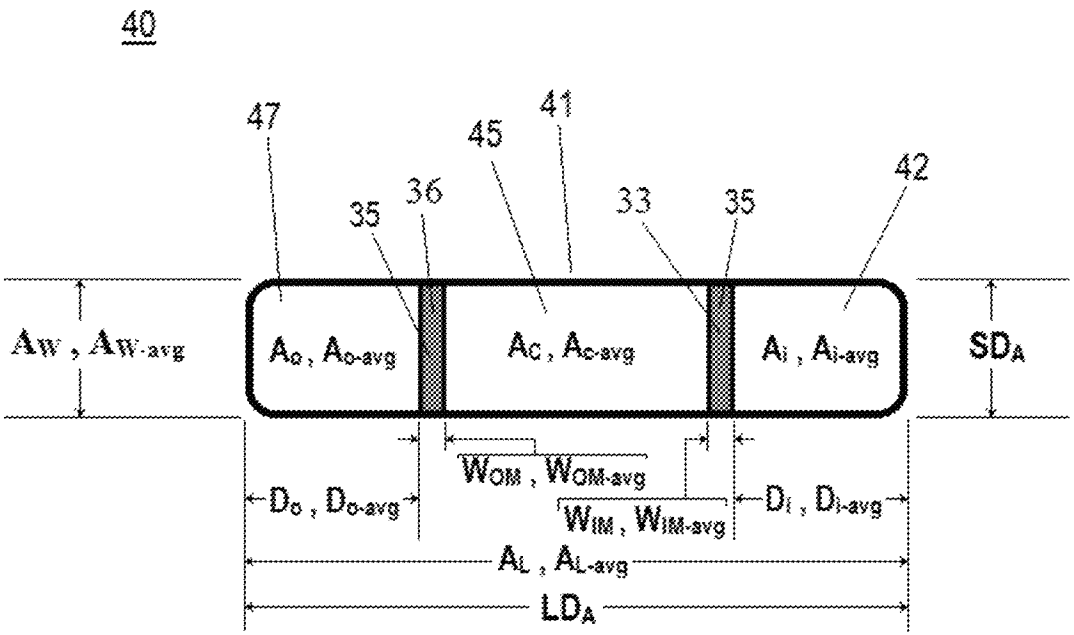
FIG. 5 is a detail of the plurality of apertures of FIG. 4.
Figure 6:
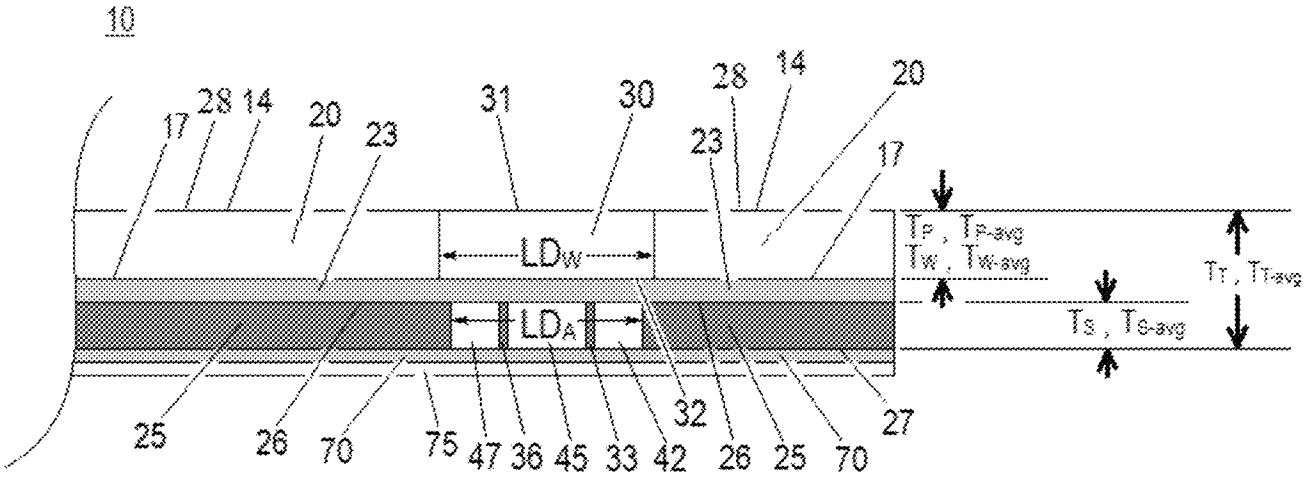
FIG. 6 is a depiction of a cross sectional, cut away, elevational view of a chemical mechanical polishing pad of the present invention.
Figure 7:
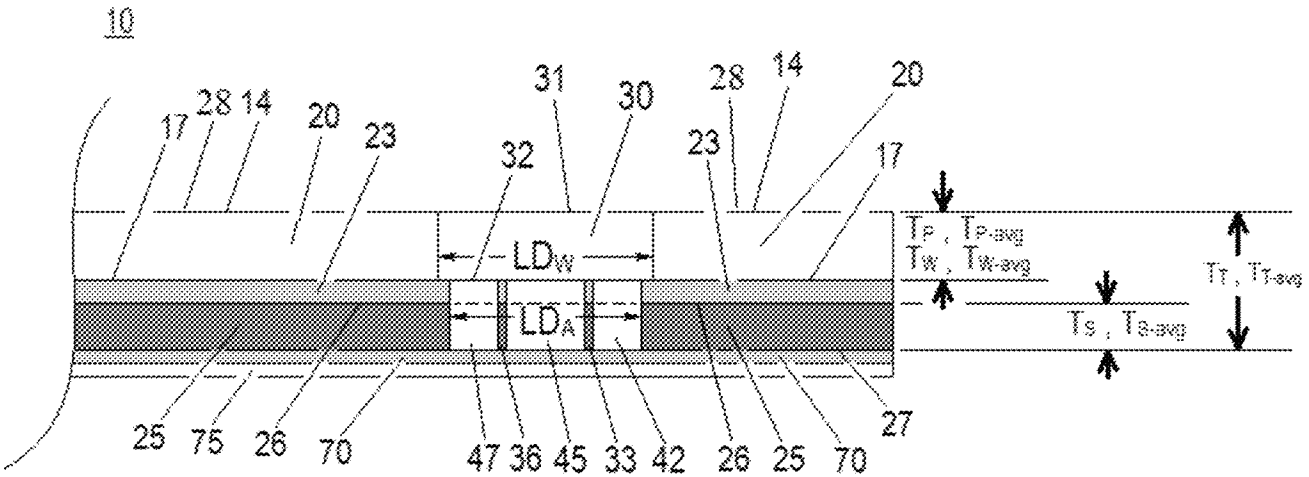
FIG. 7 is a depiction of a cross sectional, cut away, elevational view of a chemical mechanical polishing pad of the present invention.
Figure 8:
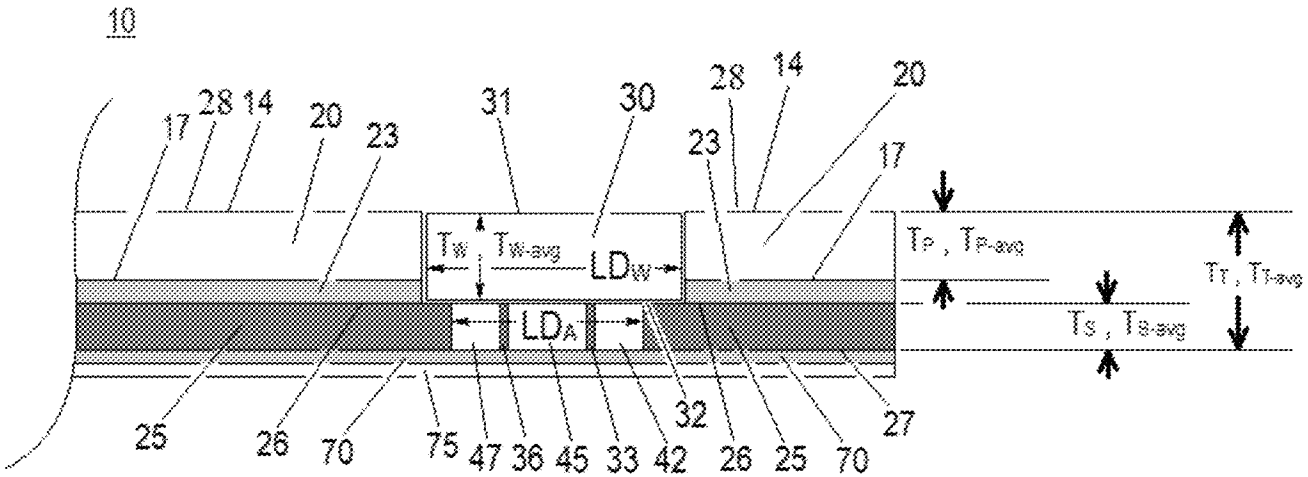
FIG. 8 is a depiction of a cross sectional, cut away, elevational view of a chemical mechanical polishing pad of the present invention.
Figure 9:
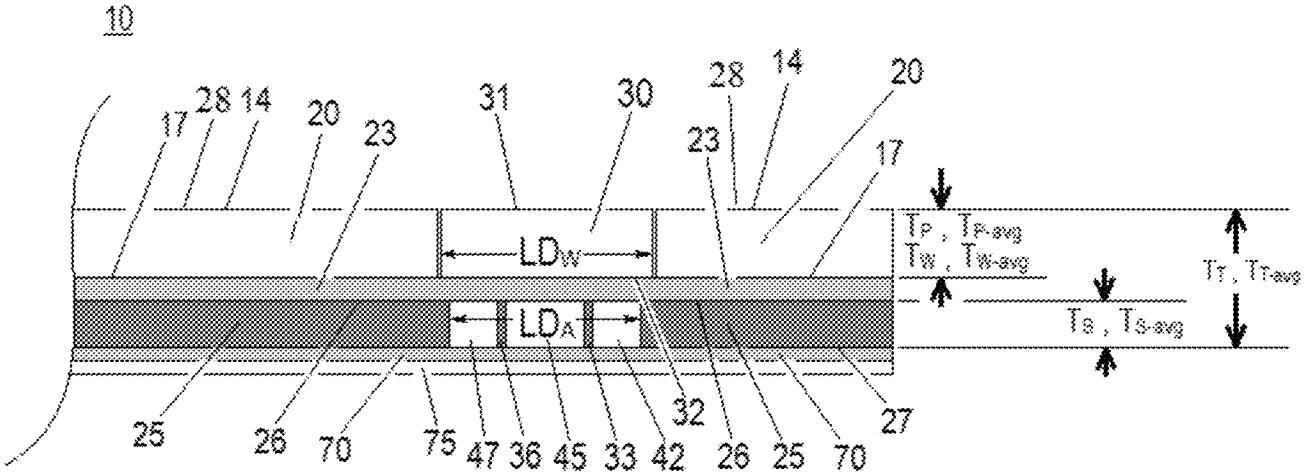
FIG. 9 is a depiction of a cross sectional, cut away, elevational view of a chemical mechanical polishing pad of the present invention.
Figure 10:
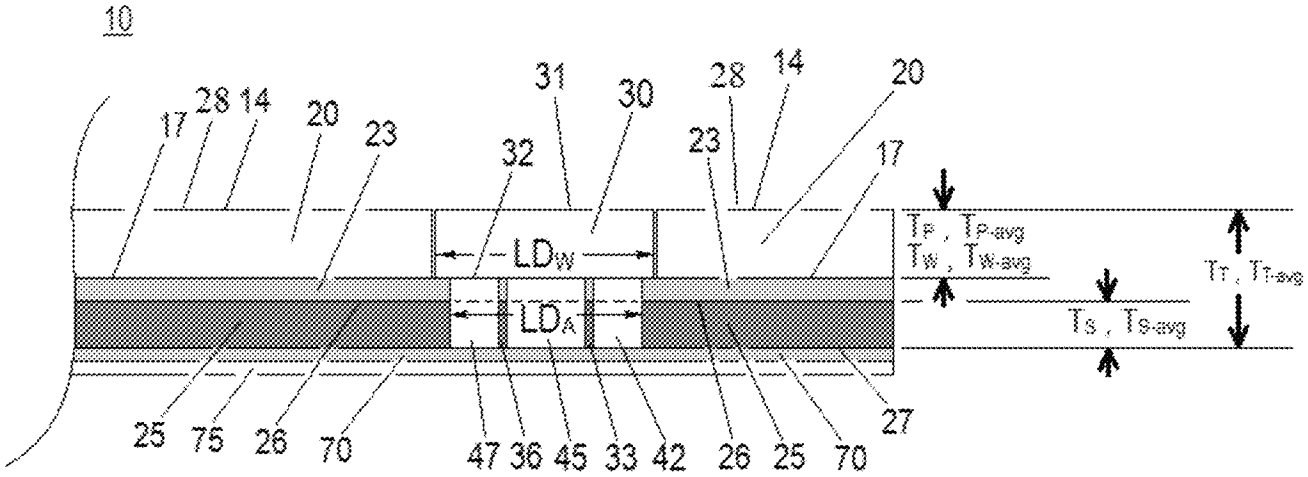
FIG. 10 is a depiction of a cross sectional, cut away, elevational view of a chemical mechanical polishing pad of the present invention.
Figure 12:
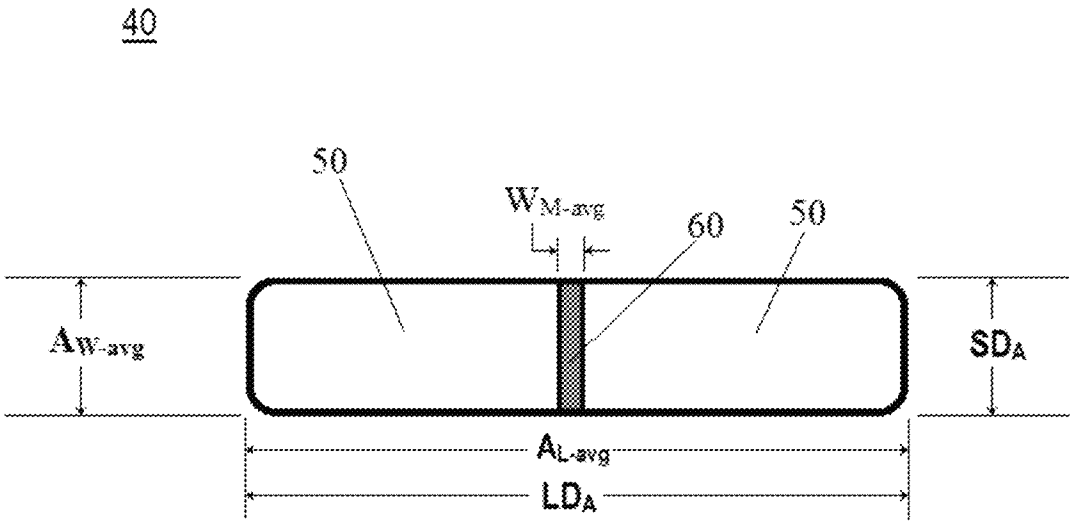
FIG. 12 is a top plan view of a plurality of apertures.
Figure 13:
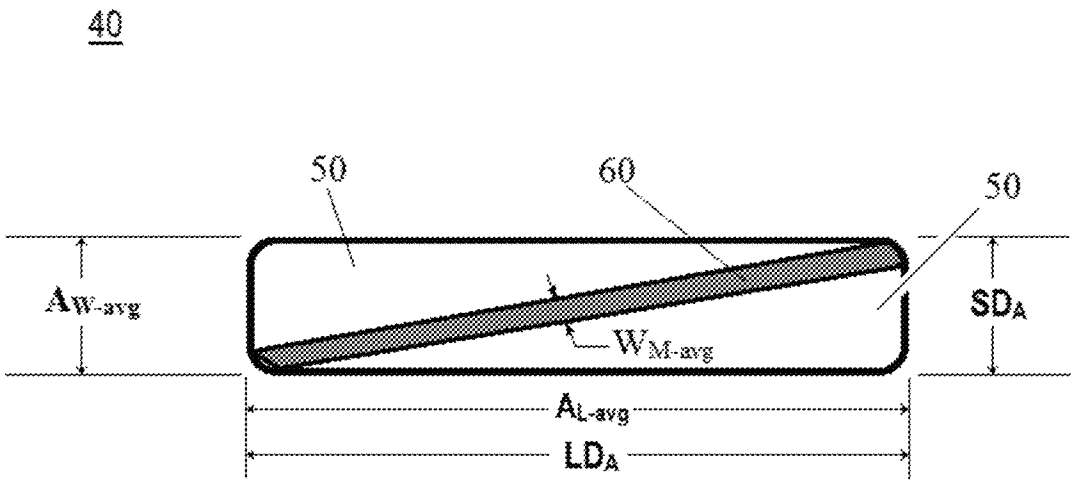
FIG. 13 is a top plan view of a plurality of apertures.
Figure 14:
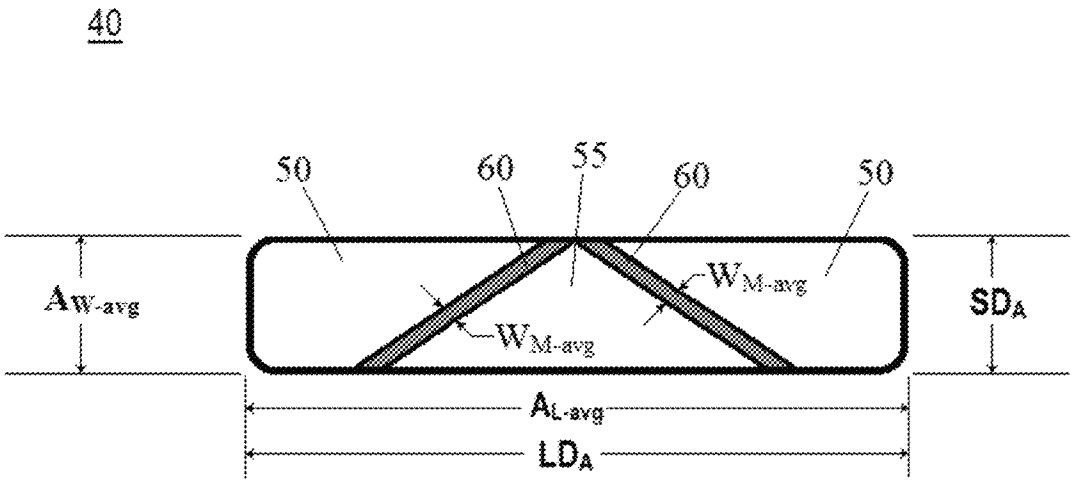
FIG. 14 is a top plan view of a plurality of apertures.

The polishing pad used in Comparative Example C1 was an unmodified commercial IC1010™ polishing pad available from Rohm and Haas Electronic Materials CMP Inc. The polishing pads used in Examples 1-5, were commercial IC1010™ polishing pads available from Rohm and Haas Electronic Materials CMP Inc., wherein the subpad structure was modified with pieces of subpad material to provide a subpad having plurality of apertures. Specifically, the subpad structure for the polishing pad used in Example 1 was modified to have a plurality of apertures (40) configured as shown in FIG. 12, wherein the plurality of apertures (40) was two equal cross sectional area apertures (50) separated by a cross member (60) having an average member width, $W_{M\text{-}avg}$, of 3.81 mm. The subpad structure for the polishing pad used in Example 2 was modified to have a plurality of apertures (40) configured as shown in FIG. 12, wherein the plurality of apertures (40) was two equal cross sectional area apertures (50) separated by a cross member (60) having an average member width, $W_{M\text{-}avg}$, of 5.08 mm. The subpad structure for the polishing pad used in Example 3 was modified to have a plurality of apertures (40) configured as shown in FIG. 5, wherein the plurality of apertures (40) was an outer aperture (47), a center aperture (45) and an inner aperture (42); wherein the outer aperture (47) was separated from the center aperture (45) by outer cross member (36); wherein the center aperture (45) was separated from the inner aperture (42) by inner cross member (33); wherein the outer aperture cross sectional area, $A_o$, and the inner aperture cross sectional area, $A_i$, were equal; wherein the average inner member width, $W_{IM\text{-}avg}$ was 3.81 mm; where the average outer member width, $W_{OM}$, was 3.81; wherein the average inner aperture dimension, $D_{i\text{-}avg}$, was 15 mm; and, wherein the average outer aperture dimension, $D_{o\text{-}avg}$, was 15 mm. The subpad structure for the polishing pad used in Example 4 was modified to have a plurality of apertures (40) configured as shown in FIG. 13, wherein the plurality of apertures (40) was two equal cross sectional area apertures (50) separated by a diagonal cross member (60) having an average cross member width, $W_{M\text{-}avg}$, of 2.54 mm. The subpad structure for the polishing pad used in Example 5 was modified to have a plurality of apertures (40) configured as shown in FIG. 14, wherein the plurality of apertures (40) was two equal cross sectional area apertures (50) and a third aperture (55); wherein the plurality of apertures (40) were separated by two diagonal cross members (60); wherein the diagonal cross members (60) both had an average cross member width, $W_{M\text{-}avg}$, of 3.81 mm.

Abrasive Conditioning

The chemical mechanical polishing pads prepared according to each of Comparative Example C1 and Examples 1-5, were mounted on the platen of an Applied Materials 200 mm Mirra® polisher set with a down force of 62 kPa (9 psi), a deionized water flow rate of 200 ml/min, a table rotation speed of 93 rpm, a carrier rotation speed of 87 rpm and an AM02BSL8031C1-PM (AK45) diamond conditioning disk (commercially available from Saesol Diamond Ind. Co., Ltd.). Each of the chemical mechanical polishing pads was then continuously conditioned for six hours. The initial Applied Materials 200 mm Mirra® polisher ISRM EPD detected signal strength percent and the post conditioning signal strength percent measured are reported in Table 1.

TABLE 1

| Ex. | Start signal (%) | Post conditioning signal (%) |
|---|---|---|
| C1 | 54-56 | 34-37 |
| 1 | 36-40 | 24 |
| 2 | 28 | 18 |
| 3 | 50 | 27 |

TABLE 1-continued

| Ex. | Start signal (%) | Post conditioning signal (%) |
|---|---|---|
| 4 | 43 | 27 |
| 5 | 40 | 27 |

Figure 15:
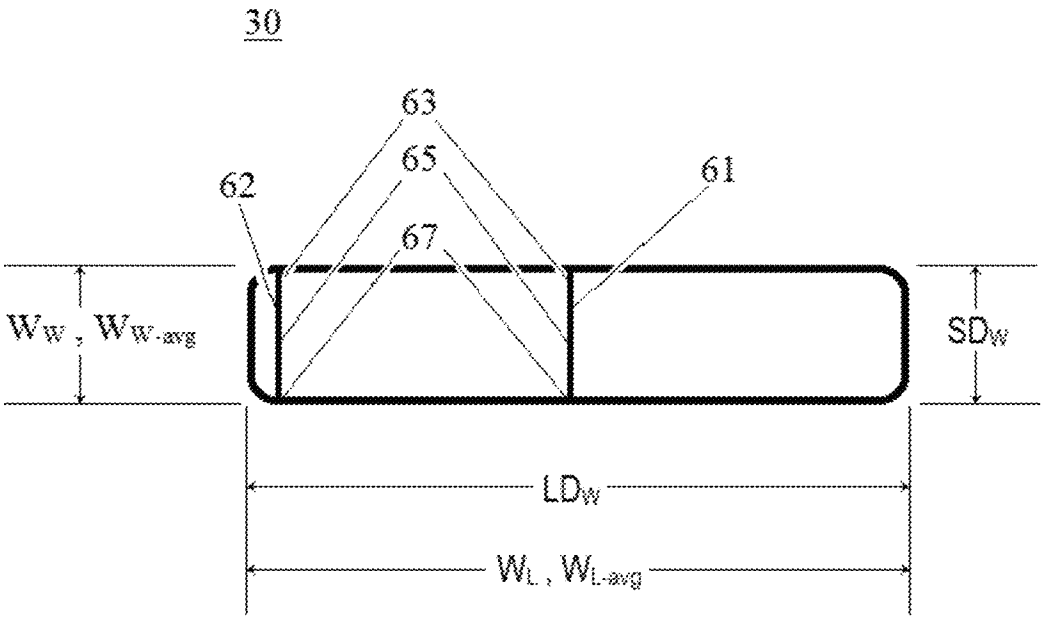
FIG. 15 is a top plan view of the polishing side of an endpoint detection window.

The window thickness of the endpoint detection window (30) from Comparative Example C1 and Example 3 were measured before and after conditioning along the center line (61) at the middle (65), at the leading edge (63) and at trailing edge (67); and, along the outer line (62) at the middle (65), at the leading edge (63) and at trailing edge (67). (See FIG. 15). The results are provided in TABLE 2.

TABLE 2

| | | Window thickness, $T_w$ (in mm) | | | | | |
|---|---|---|---|---|---|---|---|
| | Conditioning | leading edge | | Middle | | Trailing edge | |
| Ex. | status | Center | Outer | Center | Outer | Center | Outer |
| C1 | pre | 2.17 | 2.17 | 2.17 | 2.17 | 2.17 | 2.17 |
| C1 | post | 1.72 | 1.78 | 1.71 | 1.75 | 1.72 | 1.79 |
| 3 | pre | 2.18 | 2.18 | 2.18 | 2.18 | 2.18 | 2.18 |
| 3 | post | 1.78 | 1.78 | 1.77 | 1.79 | 1.78 | 1.78 |

We claim:

1. A chemical mechanical polishing pad, comprising:

a polishing layer having a central axis, an outer perimeter, a polishing surface, a base surface and a polishing layer thickness, $T_P$, perpendicular to a plane of the polishing surface measured from the polishing surface to the base surface;

an endpoint detection window having a polishing side, a platen side and a window thickness, $T_W$, perpendicular to the polishing side measured from the polishing side to the platen side;

a subpad having a top surface, a bottom surface, a plurality of cross members, a plurality of apertures, an outer edge and a subpad thickness, $T_S$, perpendicular to the top surface measured from the top surface to the bottom surface; wherein the plurality of apertures are separated by the plurality of cross members; wherein the plurality of apertures comprises at least three adjacent apertures; wherein the three adjacent apertures consist of an inner aperture, a center aperture and an outer aperture; wherein the inner aperture has an inner aperture cross sectional area, $A_i$, parallel to the plane of the polishing surface, wherein the inner aperture cross sectional area, $A_i$, is substantially constant across the subpad thickness, $T_s$; wherein the center aperture has a center aperture cross sectional area, $A_c$, parallel to the plane of the polishing surface wherein the center aperture cross sectional area, $A_c$, is substantially constant across the subpad thickness, $T_s$; wherein the outer aperture has an outer aperture cross sectional area, $A_o$, parallel to the plane of the polishing surface wherein the outer aperture cross sectional area, $A_o$, is substantially constant across the subpad thickness, $T_s$; wherein the plurality of cross members consists of an inner member and an outer member; wherein the inner member separates the inner aperture from the center aperture; and, wherein the outer member separates the center aperture from the outer aperture; and, a stack adhesive;

wherein the endpoint detection window is incorporated into the chemical mechanical polishing pad, wherein the polishing side is disposed toward the polishing surface of the polishing layer;

wherein the stack adhesive is interposed between the base surface of the polishing layer and the top surface of the subpad;

wherein the plurality of apertures is in optical communication with the endpoint detection window; and, wherein the polishing surface of the polishing layer is adapted for polishing of a substrate.

2. The chemical mechanical polishing pad of claim 1, wherein the plurality of apertures extend from the bottom surface of the subpad to the top surface of the subpad.

3. A method of polishing, comprising:

providing a chemical mechanical polishing apparatus having a table, a light source and a photosensor;

providing a substrate;

providing a chemical mechanical polishing pad of claim 1;

installing onto the table the chemical mechanical polishing pad with the polishing surface disposed away from the table;

optionally, providing a polishing medium at an interface between the polishing surface and the substrate;

creating dynamic contact between the polishing surface and the substrate, wherein at least some material is removed from the substrate; and, determining a polishing endpoint by transmitting light from the light source through the endpoint detection window and analyzing the light reflected off the substrate, back through the endpoint detection window and incident upon the photosensor.

4. The chemical mechanical polishing pad of claim 1, wherein the outer aperture has an outer aperture average cross sectional area, $A_{o\text{-}avg}$, parallel to the plane of the polishing surface across the subpad thickness, $T_s$;

wherein the inner aperture has an inner aperture average cross sectional area, $A_{i\text{-}avg}$, parallel to the plane of the polishing surface across the subpad thickness, $T_s$;

wherein the center aperture has an center aperture average cross sectional area, $A_{c\text{-}avg}$, parallel to the plane of the polishing surface across the subpad thickness, $T_s$; and, wherein $$0.75*A_{o\text{-}avg} \leq A_{i\text{-}avg} \leq 1.25*A_{o\text{-}avg}; \text{ and,}$$

$$0.5*(A_{i\text{-}avg}+A_{o\text{-}avg}) \leq A_c \leq 1.25*(A_{i\text{-}avg}+A_{o\text{-}avg}).$$

5. The chemical mechanical polishing pad of claim 4, wherein the endpoint detection window has a window cross sectional area, $W_a$, parallel to the plane of the polishing surface; wherein the window cross sectional area, $W_a$, is substantially constant across the window thickness, $T_W$.

6. The chemical mechanical polishing pad of claim 5, wherein the endpoint detection window has a window length, $W_L$, parallel to the plane of the polishing surface measured along a window long dimension, $LD_W$, of the endpoint detection window;

wherein the endpoint detection window has a window width, $W_W$, parallel to the plane of the polishing surface measured along a window short dimension, $SD_W$, of the endpoint detection window;

wherein the window long dimension, $LD_W$, is perpendicular to the window short dimension, $SD_W$;

wherein the polishing layer has a polishing layer radial line, $PL_R$, on the plane of the polishing surface that intersects the central axis and extends through the outer perimeter of the polishing layer;

wherein the endpoint detection window is incorporated into the chemical mechanical polishing pad such that the window long dimension, $LD_W$, projects a window long dimension projection, $pLD_W$, on the plane of the polishing surface; wherein the window long dimension projection, $pLD_W$, substantially coincides with the polishing layer radial line, $PL_R$;

wherein the plurality of apertures have an aperture length, $A_L$, parallel to the plane of the polishing surface measured along an aperture long dimension, $LD_A$, of the plurality of apertures;

wherein the plurality of apertures have an aperture width, $A_W$, parallel to the plane of the polishing surface measured along an aperture short dimension, $SD_A$, of the plurality of apertures;

wherein the aperture long dimension, $LD_A$, is perpendicular to the aperture short dimension, $SD_A$; and, wherein the plurality of apertures is integrated into the subpad such that the aperture long dimension, $LD_A$, projects an aperture long dimension projection, $pLD_A$, on the plane of the polishing surface; wherein the aperture long dimension projection, $pLD_A$, substantially coincides with the window long dimension projection, $pLD_W$.

7. The chemical mechanical polishing pad of claim 6, wherein the inner member has an inner member width, $W_{IM}$, parallel to the plane of the polishing surface measured along the aperture long dimension, $LD_A$, of the plurality of apertures;

wherein the outer member has an outer member width, $W_{OM}$, parallel to the plane of the polishing surface measured along the aperture long dimension, $LD_A$, of the plurality of apertures;

wherein the inner aperture has an inner aperture dimension, $D_i$, parallel to the plane of the polishing surface measured along the aperture long dimension, $LD_A$, of the plurality of apertures;

wherein the outer aperture has an outer aperture dimension, $D_o$, parallel to the plane of the polishing surface measured along the aperture long dimension, $LD_A$, of the plurality of apertures;

wherein the aperture length, $A_L$, of the plurality of apertures is essentially constant across the subpad thickness, $T_S$, and across the aperture width, $A_W$, of the plurality of apertures;

wherein the plurality of apertures has an average aperture length, $A_{L\text{-}avg}$, across the subpad thickness, $T_S$, and across the aperture width, $A_W$, of the plurality of apertures;

wherein the aperture width, $A_W$, of the plurality of apertures is essentially constant across the subpad thickness, $T_S$, and across the aperture length, $A_L$, of the plurality of apertures;

wherein the plurality of apertures has an average aperture width, $A_{W\text{-}avg}$, for the plurality of apertures across the subpad thickness, $T_S$, and across the aperture length, $A_L$, of the plurality of apertures; and, wherein $$A_{L\text{-}avg} \leq W_{L\text{-}avg}; \text{ and,}$$

$$A_{W\text{-}avg} \leq W_{W\text{-}avg}.$$

* * * * *